United States Patent [19]

Emigh et al.

[11] Patent Number: 5,056,767

[45] Date of Patent: Oct. 15, 1991

[54] DEVICE FOR INTERFACING A HIGH-SPEED PRINTER TO POST-PRINTER RECEIVING EQUIPMENT

[75] Inventors: Jonathan D. Emigh, Somerset; Raymond P. Porter, Sherian, both of Calif.

[73] Assignee: U.S. Computer Services, Sacramento, Calif.

[21] Appl. No.: 525,885

[22] Filed: May 17, 1990

[51] Int. Cl.[5] ..... B65H 39/02

[52] U.S. Cl. ..... 270/58; 270/52

[58] Field of Search ..... 270/1.1, 32, 37, 45, 270/52, 53, 54, 55, 56, 57, 58; 414/788.1, 788.8, 789.9

[56] References Cited

U.S. PATENT DOCUMENTS

| | | | |
|---|---|---|---|
| 4,273,319 | 6/1981 | Stocker | 270/58 |
| 4,572,497 | 2/1986 | Dreschel | 270/58 |
| 4,731,048 | 3/1988 | Marella et al. . | |
| 4,733,856 | 3/1988 | Gunther | 270/58 |
| 4,768,767 | 9/1988 | Orr et al. . | |
| 4,796,196 | 1/1989 | Durst, Jr. et al. . | |
| 4,800,504 | 1/1989 | Durst, Jr. et al. . | |
| 4,800,505 | 1/1989 | Axelrod et al. . | |
| 4,800,506 | 1/1989 | Axelrod et al. . | |
| 4,817,042 | 3/1989 | Pintsov . | |
| 4,825,378 | 4/1989 | Yuge . | |
| 4,835,544 | 5/1989 | Winterburn . | |
| 4,901,994 | 2/1990 | Ishiguro | 270/58 |
| 4,946,152 | 8/1990 | Ishikawa | 270/58 |

FOREIGN PATENT DOCUMENTS

| | | | |
|---|---|---|---|
| 6629 | 1/1980 | European Pat. Off. | 270/58 |

*Primary Examiner*—Edward K. Look
*Assistant Examiner*—Therese M. Newholm
*Attorney, Agent, or Firm*—James M. Ritchey

[57] ABSTRACT

An interfacing device for collating from a printer and transferring to post-printer receiving equipment, as a document packet, a complete designated document having one or more printed document pages is disclosed. The device comprises a collating tray positioned to accept from the printer each document page, a solenoid initiated system for transferring the document packet from the collating tray to post-printer receiving equipment, and an electronic information control system for tracking documents and informing the solenoid initiated transferring system that the complete designated document is printed and within the collating tray ready for transferring to the post-printer receiving equipment.

9 Claims, 5 Drawing Sheets

DEVICE FOR INTERFACING A HIGH-SPEED PRINTER TO POST-PRINTER RECEIVING EQUIPMENT

BACKGROUND OF THE INVENTION

1. Field of the Invention

An electromechanical document processing interface device is disclosed for collecting and collating, from a printer, multiple pages of a designated document and delivering these pages as a unit or document packet to post-printing receiving equipment for additional processing.

2. Description of the Background Art

Various electronic and mechanical devices exist for processing printed information documents. Some of these devices function separately or in combination as collection and collating means for printers. Still other simplistic systems exit for connecting a printer's physical printed output to a receiving unit's input. Documents such as bills, inventories, generalized statements, and the like, that are generated by converting relevant directly read of previously stored information into a paper copy by a printing means such as a standard ink printer, photocopying device, and equivalent apparatus often require multiple pages to contain the entire complement of stored information. This being the case, when such an informational document is printed the plurality of pages must be grouped together. Printing devices usually produce one page of the document at a time. Once the complete document is produced, those pages then need to be transferred to the next processing station.

Current photocopy machines are capable of high page output volumes. The massive output presents a particular problem when sets of pages comprise one document packet. If the output document packets are to be transferred to further post-printer processing equipment the transferring mechanism must keep up with the continual high flow of completed document packets exiting the printer. The subject device accomplishes this goal. None of the prior devices has the versatility, simplicity, reliability, and multiple capabilities of the subject device. Previous devices did not allow a user to collect and collate a multipage printed output of a designated document from a high-speed printer into a document packet and immediately transfer that packet, and a series of additional packets, to further processing equipment. The subject device solves the high volume flow problem by quickly collecting and collating a desired multipage document into a document packet and essentially immediately transferring that packet into the processing stream for further manipulations by additional equipment. Once a packet is transferred, the subject device is ready for receiving more pages of the next designated document. The subject system works efficiently to send multipage document packets from the output of the printer to any mated receiving equipment.

Disclosed in U.S. Pat. No. 4,731,048 is a method of making envelope and letter assemblies with a business letter fold. This patent refers only to a particular type of folding system and is not directly related to an interfacing system between a printer and, in this case, an envelope maker and stuffer.

A sheet distributing method and apparatus is related in U.S. Pat. No. 4,768,767. A complex collator control system is presented wherein the device automatically finds an appropriate set of empty bins for the desired printing, which may be folded or not, and the printed matter is transferred by conveyor belt from the printer to the next processing unit.

U.S. Pat. Nos. 4,796,196 and 4,800,504 present a letter processing apparatus with an interactive outgoing and incoming processing system. Conventional single sheet feeding mechanisms are provided for transferring printed matter from one location to another.

A mail preparation system is disclosed in U.S. Pat. No. 4,800,505. Printed documents are simply physically transferred from the printer to inserter system without details as to the process.

U.S. Pat. No. 4,800,506 describes an apparatus for preparing mail pieces. A computer driven system is designed to hold relevant mail piece information, instruct the printer to print desired information, and to deliver needed stationary items into the printer.

An insertion method and system with prioritized selection of inserts is discussed in U.S. Pat. No. 4,817,042. This is a computer driven system that optimizes, based on a pre-established set of criteria, the desired weight to postage value for a piece of mail.

U.S. Pat. No. 4,825,378 discloses a bundler for handling bills of different denominations, including a system for tracking unbundled bills. Similar sheets of paper are stacked and transferred as a bundled unit. The system has means for detecting bill denominations and the number of bills in different locations during processing.

A printing and packaging system with a method of identifying an item of printed matter is related in U.S. Pat. No. 4,835,544. Documents are printed with text and identifying markings and stored in a buffer area. The printed documents are feed to a cutter, if continuous paper is used, and then to a folder. The identifying markings are scanned and any indicated inserts are supplied to an insertion machine along with the necessary envelopes. An appropriate address is printed on the receiving envelopes. The entire system is under computer control. No details are given as to document transferring means.

SUMMARY OF THE INVENTION

An object of the present invention is to produce an interfacing device that links a printer to any general type of post-printer receiving and processing equipment.

A further object of the present invention is to provide an interfacing device capable of collecting, collating, and transferring, as discrete separate units, complete document packets, usually having multiple pages, from a high-speed printer to post-printer receiving equipment.

An additional object of the present invention is to create a high-speed collecting, collating, and transferring device for linking a high-speed printer to post-printer processing equipment, whereby a document packet, generally of multiple pages, is collected in correct sequence and delivered as a unit to the attached processing equipment.

Another object of the present invention is to provide an easily detachable printer to post-printer receiving equipment interface device that may be readily moved and configured to accommodate various printer to post-printer receiving equipment combinations.

Still another object of the present invention is to furnish an electronically triggered interface system that is capable of detecting electronic processing signals from printers manufactured by various printer producers and employing this information to collect, collate, and deliver a multipage document packet from a printer to a variety of post-printer receiving or processing equipment.

Disclosed is an interfacing device for collecting and collating from a printer and transferring to post-printer receiving equipment, as a document packet, a complete designated document having one or more printed document pages. More specifically, the device comprises a collecting or collating tray positioned to accept from the printer each designated document page as it is printed. Integral with the collating tray is a solenoid driven system for transferring the document package from the collating tray to any acceptable post-printer receiving equipment. For indicating when a complete designated document has been printed, an electronic information control system tracks a document and informs the solenoid initiated transferring system that the desired pages are within the collating tray and ready for transferring to the post-printer receiving equipment.

Other objects, advantages, and novel features of the present invention will become apparent from the detailed description that follows, when considered in conjunction with the associated drawings.

DESCRIPTION OF THE PREFERRED EMBODIMENT

Referring now to FIGS. 1–5, there is shown a preferred embodiment of a process and interfacing device for collating printed output from a printer and transferring to post-printer receiving equipment, as a document packet, a complete designated document having one or more printed document pages. The interfacing device comprises a collecting or collating tray positioned to accept from the printer each document page, a solenoid initiated packet transferring system for transferring the document packet from the collating tray to post-printer receiving equipment, and an electronic information control system for tracking a document and informing the packet transferring system that the complete designated document is printed and within the collating tray ready for transferring to further post-printer receiving equipment.

For purposes of this disclosure, a document shall include relevant information concerning a particular bill, inventory, item list, account for goods or services, statement, and similar or equivalent matters. Frequently, when printed, such documents have more than one page. A document packet comprises a plurality or set of relevant, related pages for any particular document. Although document information is preferably stored for ready access in standard memory devices, document information may be input via methods such as keyboard entry, readings of bar code type indicia, and similar procedures.

The exact type of printer is not critical to the subject invention, as long as it is a cut sheet printer and not working on a continuously fed paper roll that is cut to size after printing. Traditional printing and photocopying devices are considered to be within the realm of this disclosure. Such printers and general copying devices are manufactured by various producers such as Xerox®, Kodak®, IBM® and others. Of particular interest are what have been termed "high-speed" printers usually employing laser printing techniques capable of high page outputs. The volume of pages produced by such high-speed printers requires rapid and reliable processing equipment to collect, collate, and transfer a document packet. The subject invention implements a device and method that permits reliable and efficient document handling.

Figure 1:
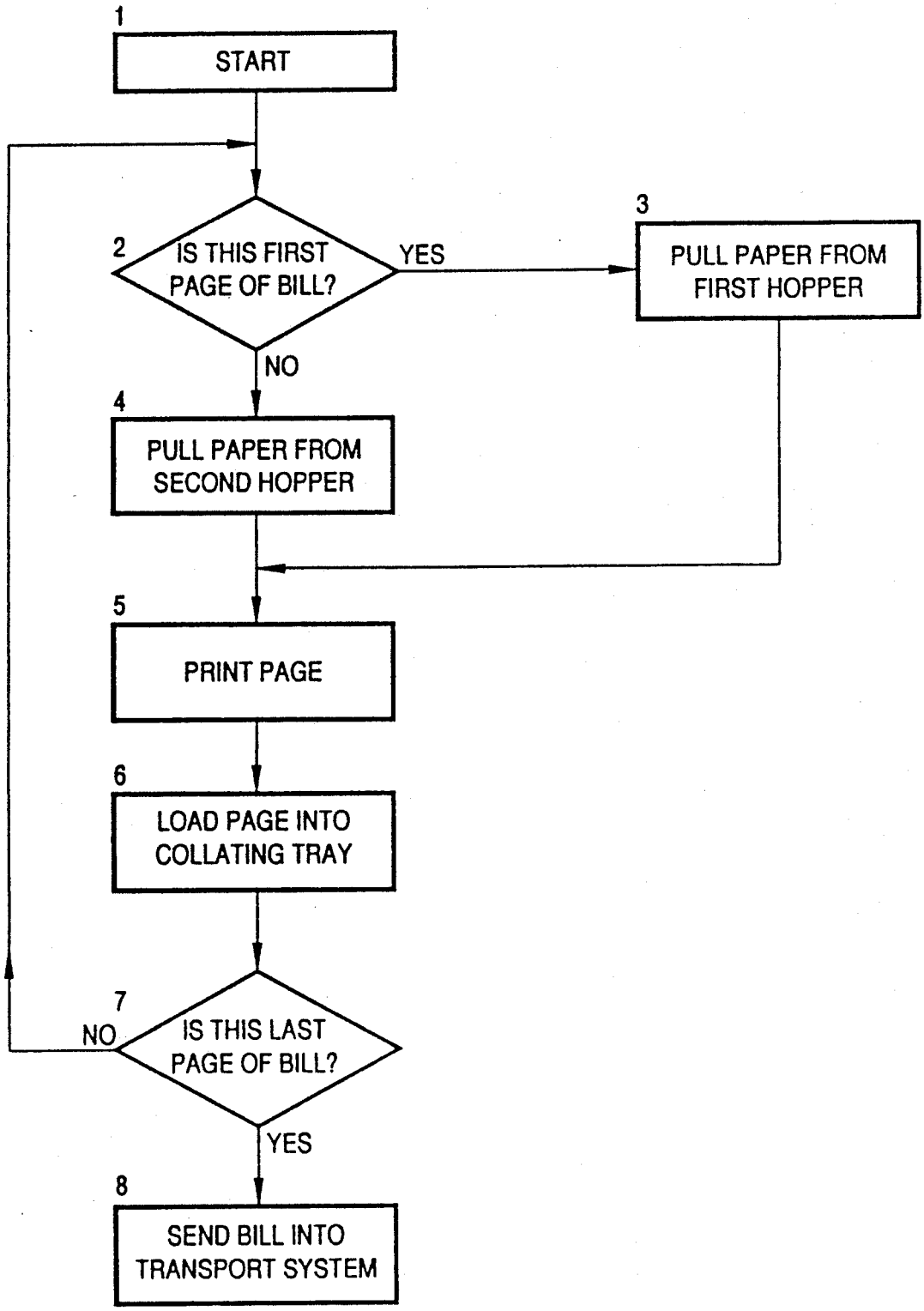
FIG. 1 is an informational flow diagram of the subject invention.

FIG. 1 illustrates the basic elements of the informational flow process of the subject invention. Information for a particular document is transferred to a printer to start 1 the document printing process. A control or document information monitoring system follows the flow of information coming from the printer to establish when a particular document, having one or more pages, has been printed and is ready for transfer to post-printing receiving equipment or processing stations. Such post-printing receiving or processing stations include, but are not limited to, envelope stuffers, flier inserters, folders, outstackers, and the like.

For purposes of this detailed embodiment description, a three page bill will be used as a typical document example, but as indicated above, various types of documents from one to many pages may be handled by the subject invention. First, the monitoring system of the subject invention establishes if a bill page to be copied by the printer is the first page of the bill 2. If the monitoring system receives confirmation that the page is the first bill page, the printer feeds in a sheet of paper from a first hopper 3. If the response is in the negative, the printer feeds in a sheet of paper from a second hopper 4. The first hopper typically contains letterhead paper appropriate for a first or cover page to the bill. Within the second hopper are generally sheets of paper suitable for other than cover page printing.

For illustrative purposes, assume the monitoring or information control system detects that a sheet of paper is to be pulled from the first hopper 3 for a cover page to a new bill, immediately following the introduction of the cover sheet into a printer's printing domain the first page is printed 5. This printed page is ejected from the printer and loaded or collected into a collating tray 6. The monitoring system queries if this printed page is the last page of the bill 7. A negative response loops the monitoring system back to the earlier decision point for establishing if the next page is the first page of the bill 2. Since, for this example (three total bill pages) it is not, a sheet of paper is pulled from the second hopper 4, the second page printed 5, and loaded into the collating tray 6. Once again the monitoring system queries if this page is the last page of the bill 7 and, for this example, receives a negative response. Again the monitoring system loops back to the first page question 2 and proceeds on to the last page question 7. Since for this example the bill comprises three pages, when the monitoring system queries if this is the last page of the bill the answer is positive and the three page bill packet is sent to post-printer receiving equipment 8.

Figure 2:
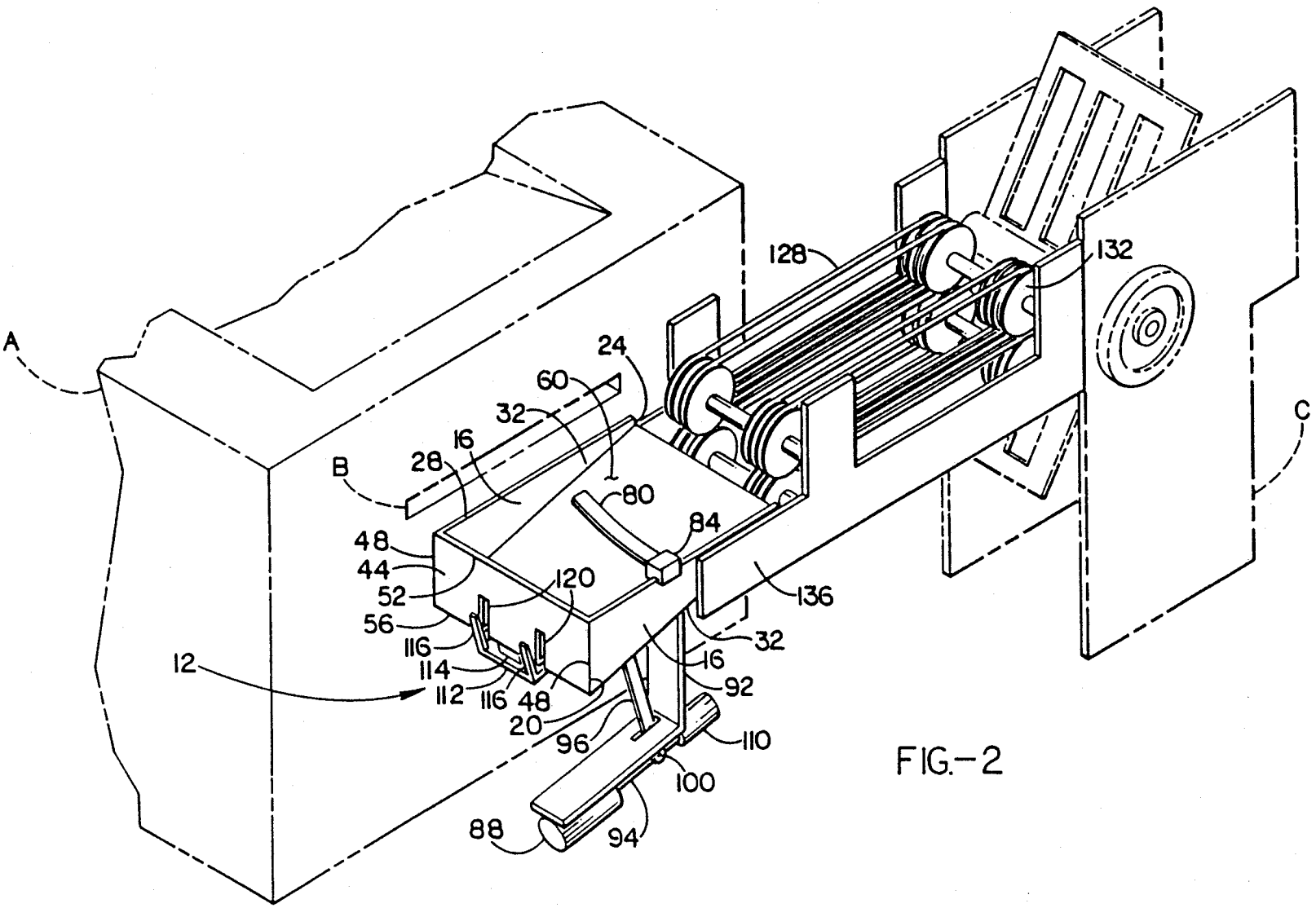
FIG. 2 is a perspective view of the subject invention.
Figure 3:
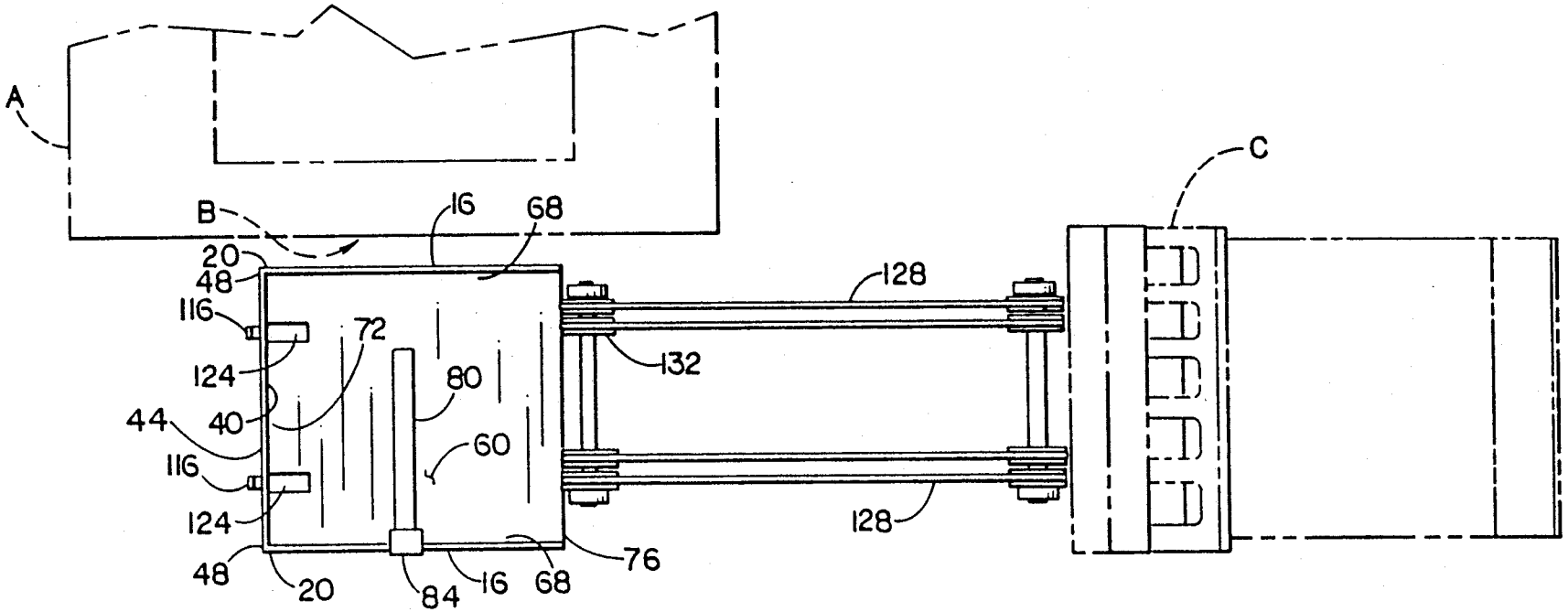
FIG. 3 is a top view of the subject invention (with conveyor system side plates removed).
Figure 4:
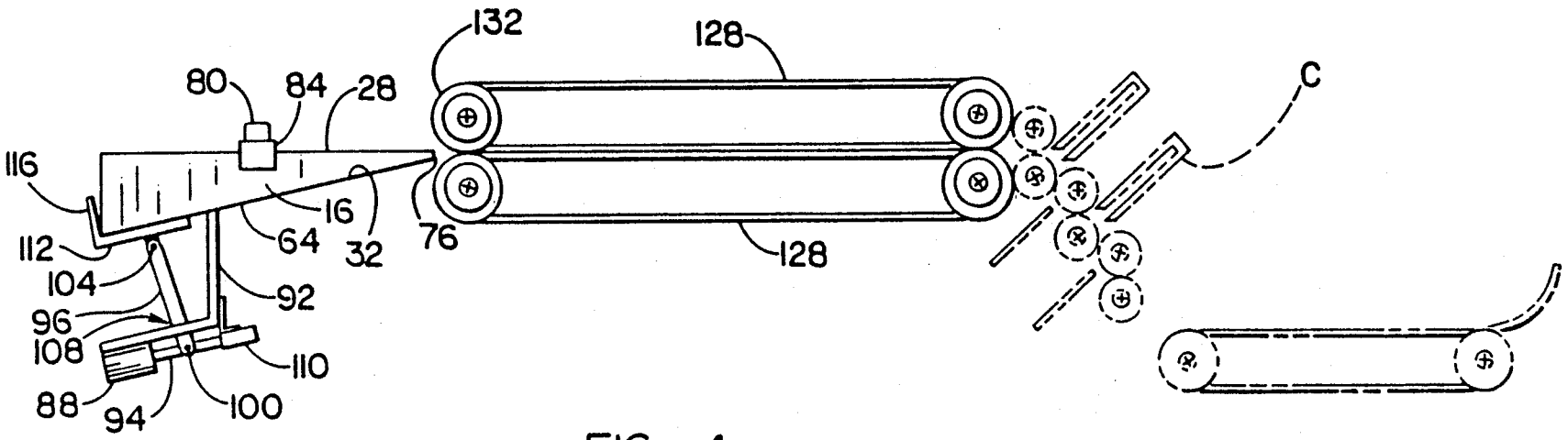
FIG. 4 is a side view of the subject invention (with conveyor system side plates removed).

To actuate the bill or general document processing scheme described immediately above and flow charted in FIG. 1, the physical elements disclosed in FIG. 2–4 are related for the subject interface device 12 employed for collating into a document the output of a printer and transferring to post-printer receiving equipment a complete designated document having one or more printed document pages. A generic or typical printer A is denoted in FIGS. 2 and 3. As indicated above, this printer A is preferably a laser printer having a printer output opening B from which printed pages exit for collection by the subject device 12. Following the subject device 12, in the typical flow path for a printed document packet, are the various pieces of post-printer receiving equipment. For illustrative purposes, a folder C could be connected to the subject device, but any combination of post-printer receiving equipment or processing stations is contemplated by this disclosure.

Specifically, the subject invention 12 comprises a collating tray for accepting from the printer A, via the printer opening B, the printed pages of a document. The collating tray comprises a three walled printed page receptacle. Two of the three receptacle walls are formed by two longitudinal side walls 16, with each side wall 16 having proximal 20 and distal 24 ends and upper 28 and lower 32 edges. The third receptacle wall comprises a transverse back wall having inner 40 and outer 44 surfaces. The back wall has two opposing ends 48 with upper 52 and lower 56 edges connecting the proximal side wall 20 ends, one of the proximal side wall ends 20 at each of the back wall opposing ends 48. (It should be noted that in this disclosure, the terms proximal and distal refer to a relative references in which a proximal portion is nearest the back wall and a distal location is further away from the back wall.)

The collating tray further comprises a generally rectangular floor plate with top 60 and bottom 64 surfaces. Around the perimeter of the floor plate are two longitudinal side edges 68 and proximal 72 and distal 76 end edges. The floor plate is secured within the three walls at an angle running from the back wall lower edge 56 to the side wall distal end 24 proximate the side wall upper edge 28. This sloped tray bottom, by the action of gravity, forces the printed pages to slide down within the tray, thereby aligning one page edge proximate with the back wall inner surface 40. The slope of the collating tray bottom keeps the printed pages within the receptacle until a document packet is ejected to further post-printing receiving equipment.

A preferred option, secured to the side wall upper edge 28, is an adjustable printed page deflector comprising a deflector arm 80 fastened to an adjustable deflector arm mounting bracket 84. When a printed page exits the printer via the printer output opening B, the page is immediately directed down into the collating tray by the deflector arm. Preferably, the deflector arm 80 is curved, but a straight arm is within the realm of this disclosure. The mounting bracket 84, firmly anchored to the deflector arm 80, has means for attachment to the side wall upper edge. Preferably this attachment means is a groove that accepts the side wall upper edge 28, although other similar attachment means are contemplated. The adjustability of the mounting bracket may be achieved by standard techniques such as set screws, clamps, and equivalent means that permit the mounting bracket 84 to slide along the side wall upper edge 28.

The subject device 12 may be supported by its own supports or other suitable means. Although printer independent support means are preferred, in any case, the subject device support means is not a critical element of the subject invention 12.

To transfer a document packet from within the collating tray to post-printer receiving equipment, a first means is provided. Although various possible methods could be devised for transferring a document packet from a collection area, the preferred and novel means for rapidly ejecting a document packet from a receptacle herein disclosed comprises a solenoid actuated system that "kicks" the document packet from within the collating tray, up the inclined or sloped floor plate and out of the receptacle. More specifically, the first transferring means comprises a solenoid 88 that is mounted by a solenoid support bracket 92 to, preferably, the collating tray, although equivalent mounting locations are possible.

Fastened to a solenoid 88 (specifically to a solenoid piston 94 that slides within the solenoid core) is an elongated lever arm 96. The lever arm 96 has first 100 and second 104 ends. The solenoid 88 connection to the lever arm 96 is by the first arm end 100. This connection is hinge-like to permit a bending movement between the lever arm 96 and piston 94 during solenoid 88 activation. The lever arm 96 is secured at a pivot point 108, between the first 100 and second 104 lever arm ends, to the solenoid support bracket 92. When the solenoid 88 is activated and the piston 94 moves, the lever arm 90 swings about the pivot point 108. To reduce excessive piston 94 movements, a damping pot 110 is usually affixed.

Fastened to the second lever arm end 104 is means for ejecting the document packet from the collating tray. Preferably, the ejecting means comprises a generally flattened base 112 with upper and lower surfaces having proximal and distal ends fastened to the second lever arm end 104 by an attachment via the base's 112 lower surface or equivalent location. For ease of movement, bearings 114, or the functional equivalent, are preferably associated with the base's 112 upper surface and the bottom floor plate surface 64. A finger member 116 is secured to the base 112 proximate the base's 112 proximal end and projecting away from the base's 112 upper surface. Usually there are two such finger members 116 with each secured to the base 112. No particular finger member 116 shape is required.

For slidable receiving each finger member 116, the back wall has a slit 120 (usually more than one slit and preferably two slits) that penetrates both of the back wall surfaces (40 and 44) and extends from the lower back wall edge 56 into the back wall towards the upper back wall edge 52. Likewise, penetrating both the top 60 and bottom 64 floor plate surfaces is a channel 124 that extends from the proximal floor plate end edge 72 into the floor plate towards the distal floor plate end edge 76. When the solenoid 88 is actuated, the finger member 116 (two finger members are illustrated in FIGS. 2 and 3) is rapidly pulled through the back wall slit 120 and into the floor plate channel 124 (held in position and aided by the bearings 114). The upper portion of each finger member 116 projects into the receptacle and ejects or kicks any document packet up the inclined floor plate and from the receptacle.

The first transferring means usually comprises an additional transfer element to accept the ejected document packet from the receptacle and to forward or transport the packet to waiting receiving equipment. This additional transfer element is preferably a conveyor belt transfer system having one or more conveyor belts 128 and associated pulleys 132. The conveyor belt transfer system is secured to the collating tray proximate the side wall distal ends 24 by standard means including the use of side plates 136 or equivalent means. The conveyor belt transfer system may be directly fastened to various post-printer receiving equipment such as a folder, as shown in FIGS. 2–4. The number of belts 128 and pulleys 132 may vary, but an upper and lower belt system (illustrated in FIGS. 2 and 4) is preferred. A document packet is accepted between the upper and lower belt systems and conveyed as an intact unit to the next processing area. The pressure between the upper and lower opposing belts is suitable for transferring document packets having one or a plurality of pages.

To power the conveyor belt transfer system a typical drive motor (under general start/stop control by the control system described below) is employed. Since the drive motor's exact location is not critical and could be associated with a post-printer receiving piece of equipment's drive components, the mounted drive motor is not shown in detail in the figures.

Figure 5:
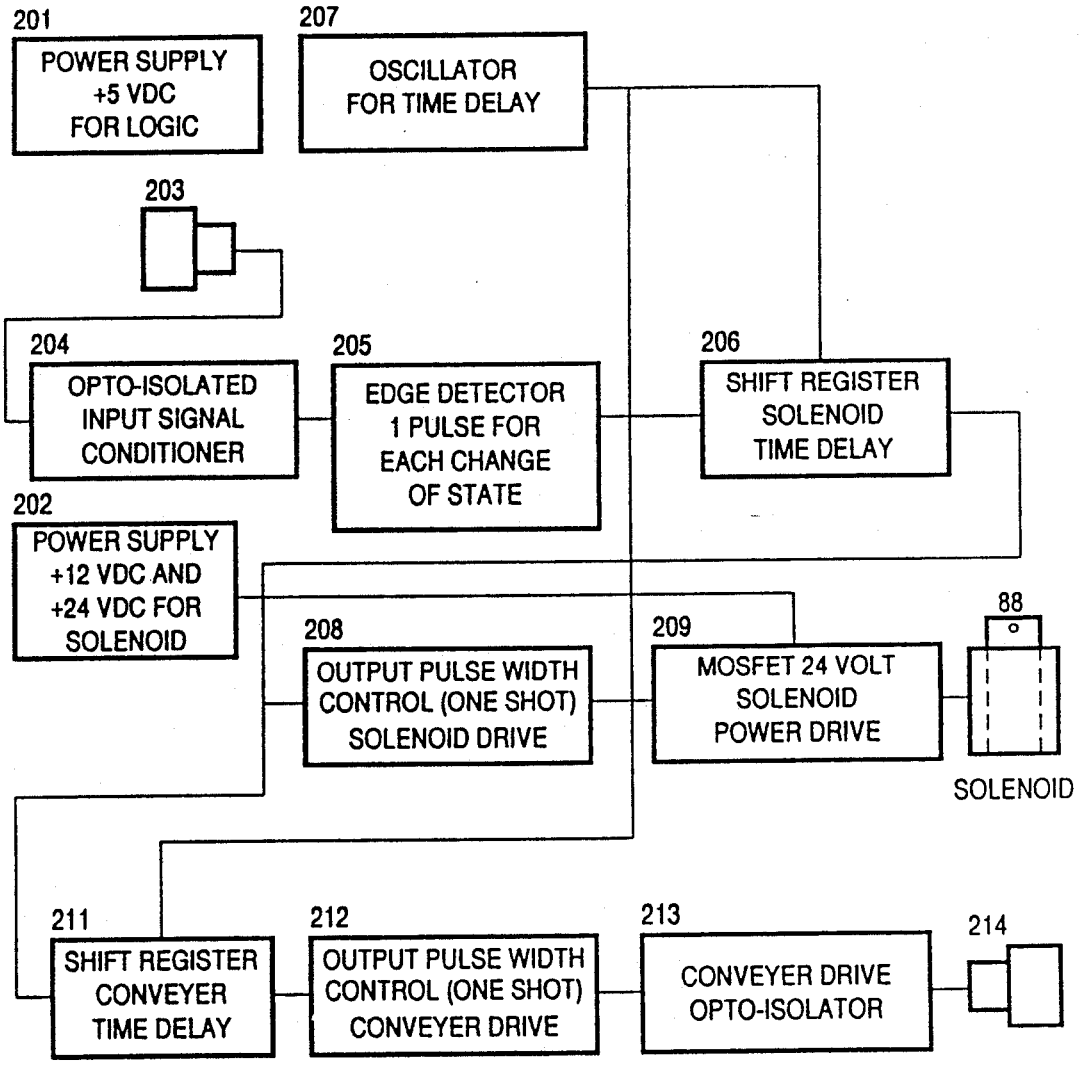
FIG. 5 is a flow diagram for the control system of the subject invention.

FIG. 5 is a flow diagram illustrating the monitoring or information control system of the subject invention. This information control system or second information means is for informing the first transferring means that a complete designated document packet is printed and that the packet is within the collating tray and ready for transferring to the post-printer receiving equipment. A signal is needed for the control system electronics to know when a document packet, or for a more specific example, a bill is completed. Once a bill was printed, optically read marks on the bill were considered for controlling the transfer of the bill to the post-printer receiving equipment, but since the chances of missing such marks are often high, thereby allowing two different bills to be sent to one person, this approach was discarded. Further, if this system were employed by a billing company that sends statements to a client's customers, many clients prefer to limit the amount of printed information on the bill.

The novel information control system relies on the printer knowing when a new bill or document is being started. From bill or general document data supplied to the printer, the printer can be made to offset each document into a complete packet as it leaves the printer. The offset signal can be used by the electronics of the subject device to determine the start of a new document. An additional embodiment of this technique comprises a document start cue being generated by the printer when a new document is due and the first page of the document is printed on a different paper stock (usually letter head stock) than the remainder of the document. Therefore, the first page is pulled from a different paper hopper and this pull signal is used to indicate the start of a new document.

A problem arises from either of these signal alternatives, however, as they normally, with most standard printers, come some time before the last document packet sheet settles in the collating tray and must be delayed to initiate a proper collating tray ejection signal. In the case when two single page documents are printed in sequence, the delay must be able to handle more than one document in delay at one time. The first document has not quite finished its delay time and settled in the collating tray when the second document needs to start its delay.

The subject device information control system overcomes a possible problem associated with a continuously running conveyor belt system coupled to an outstacking/folding device intended to shingle stack (slightly offset each document from prior and subsequent documents) the document packets as they come from the printer. Since the documents have any number of pages, usually one to fifteen pages, there may be gaps (uneven spacings) in the shingled output and when an operator scoops up the stack to place it into another tray (possibly a postal tray for mailing or other process) they might accidently slide one folded document into another. The subject device control system resolves this problem by turning on the conveyor belt only for a short period as each document is completed. This requires another delay to allow the completed document to pass through the post-printer receiving equipment (outstacking/folding or other such device) before the next document enters the conveyor belt.

Also, the subject device's information control system protects the printer from possible electrical failure with the subject device. This is accomplished by optically isolating the subject device signals from the printer.

Obviously, differences exist between the ways in which various printers electronically operate and this must be considered when adapting the subject device to a particular printer. For example, two popular printers are produced by Kodak® and Xerox®, but, with standard manipulations, other manufactured printers are likewise suitable for use with the subject device. Connection of the subject device to a Xerox® 4090 laser printer and a Kodak® laser printer require slightly different signal linking configurations.

With a Xerox® laser printer, an offset solenoid drive signal is used to indicate the start of a new document. To overcome a possibly high for one document and low for another document drive signal, an edge detector circuit is incorporated into the subject control system. This edge detector circuit gives a pulse out for each change of state of the input.

For a Kodak® laser printer, the printer's offset signal is not readily accessible. Therefore, a first page pick (to pull a cover page from a desired hopper) signal is employed. This signal was a pulse for each sheet so no edge detector was needed.

As mentioned above, FIG. 5 specifically indicates the informational flow pattern employed by the subject device. This specific example may be varied by those skilled in the art and such variations are within the realm of this disclosure. A +5 VDC power supply 201 (this value is variable and only preferred) provides voltage for the digital logic side of the circuit and the necessary current is a few hundred milliamps. The +12 VDC and +24 VDC power supply 202 (these values are variable and only preferred) provides power to the solenoid driver section. This power supply 202 needs to be able to supply sufficient current to drive or actuate the solenoid 88.

The printer signal is brought in on an input connector 203 and is fed into an input signal conditioner and opto-isolator 204. The signal from a Xerox® printer must then go through an edge detector 205 circuit to develop a pulse for each change of state of the input signal. The Kodak® printer and similar printers bypass this circuit.

The next circuit is a solenoid time delay 206. This circuit uses a clocked shift register for the delay as it can keep track of more than one delay at a time (this is necessary as more than one document may be in the delay sequence at once). The delay is clocked by an oscillator circuit 207. The delayed pulse is then sent to a solenoid pulse width control circuit 208 made up of a "one-shot" to provide the correct length pulse to drive the solenoid 88. This pulse is then sent to the power driver circuit 209 to provide the current (usually about two amps, but this value may vary) necessary for the solenoid 88 actuation.

The signal from the collator time delay 206 is brought to the conveyor time delay circuit 211 to allow time for the document to exit the collator tray and make its way through both the conveyor belt system and any additional post-printer receiving equipment such as a folder or other processing device before the next document is processed. The pulse width of the drive signal is determined by another conveyor pulse width control circuit 212, comprising a one-shot, and fed into a conveyor belt drive opto-isolator 213 and then out the output connector 214 to the either the drive control logic of either the conveyor belt motor or the post-printer receiving equipment.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. An interfacing device for collating into a document packet the output of a printer and transferring to post-printer receiving equipment a complete designated document having one or more printed document pages, comprising:

a) a collating tray for accepting from said printer each said document page, wherein said collating tray comprises a three walled printed page receptacle formed by two longitudinal side walls with proximal and distal ends and upper and lower edges, a transverse back wall having inner and outer surfaces with opposing ends and upper and lower edges connecting said proximal side wall ends, one said proximal side wall end at each said back wall opposing end, and a generally rectangular floor plate with top and bottom surfaces, two longitudinal side edges and proximal and distal end edges secured within said walls at an angle running from said back wall lower edge to said side wall distal end proximate said side wall upper edge;

b) first means for transferring said document packet from said collating tray to post-printer receiving equipment, wherein said first means for transferring said document packet from said collating tray comprises:

a solenoid mounted by a solenoid support bracket to said collating tray;

an elongated lever arm having first and second ends wherein said first lever arm end is fastened to said solenoid and pivotally secured between said lever arm ends to said solenoid support bracket; and means for ejecting said document packet from said collating tray fastened to said lever arm second end; and c) second means for informing said first means that said complete designated document is printed and said document packet is within said collating tray ready for transferring to said post-printer receiving equipment.

2. An interfacing device according to claim 1, wherein said means for ejecting comprises:

a) a generally flattened base with upper and lower surfaces having proximal and distal ends fastened to said lever arm second end;

b) said back wall having a slit penetrating both said back wall surfaces and extending from said lower back wall edge into said back wall towards said upper back wall edge;

c) said floor plate having a channel penetrating both said floor plate surfaces and extending from said proximal floor plate end edge into said floor plate towards said distal floor plate end edge; and d) a finger member secured to said base proximate said base proximal end and projecting away from said base upper surface wherein said finger member slidable fits within said slit and said channel thereby entering said receptacle whereby when said solenoid is actuated said finger member moves within said slit and said channel to eject a said documents packet.

3. An interfacing device according to claim 1, wherein said first means for transferring said document packet from said collating tray further comprises a conveyor belt transfer system secured proximate said side wall distal ends for transporting said document packet from said collating tray to said post-printer receiving equipment.

4. An interfacing device for collating into a document packet the output of a printer and transferring to post-printer receiving equipment a complete designated document having one or more printed document pages, comprising:

a) a collating tray for accepting from said printer each said document pages comprising a three walled printed page receptacle formed by two longitudinal side walls with proximal and distal ends and upper and lower edges, a transverse back wall having inner and outer surfaces with opposing ends and upper and lower edges connecting said proximal side wall ends, one said proximal side wall end at each said back wall opposing end, and a generally rectangular floor plate with top and bottom surfaces, two longitudinal side edges and proximal and distal end edges secured within said walls at an angle running from said back wall lower edge to said side wall distal end proximate said side wall upper edge;

b) first means for transferring said document packet from said collating tray to post-printer receiving equipment comprising:

a solenoid mounted by a solenoid support bracket to said collating tray;

an elongated lever arm having first and second ends wherein said first lever arm end is fastened to said solenoid and pivotally secured between said lever arm ends to said solenoid support bracket; and means for ejecting said document packet from said collating tray fastened to said lever arm second end; and c) second means for informing said first means that said complete designated document is printed and said document packet is within said collating tray ready for transferring to said post-printer receiving equipment.

5. An interfacing device according to claim 4, wherein said means for ejecting comprises:

a) a generally flattened base with upper and lower surfaces having proximal and distal ends fastened to said lever arm second end;

b) said back wall having a slit penetrating both said back wall surfaces and extending from said lower back wall edge into said back wall towards said upper back wall edge;

c) said floor plate having a channel penetrating both said floor plate surfaces and extending from said proximal floor plate end edge into said floor plate towards said distal floor plate end edge; and d) a finger member secured to said base proximate said base proximal end and projecting away from said base upper surface wherein said finger member slidable fits within said slit and said channel thereby entering said receptacle whereby when said solenoid is actuated said finger member moves within said slit and said channel to eject a said documents packet.

6. An interfacing device according to claim 4, wherein said first means for transferring said document packet from said collating tray further comprises a conveyor belt transfer system secured proximate said side wall distal ends for transporting said document packet from said collating tray to said post-printer receiving equipment.

7. An interfacing device according to claim 4, wherein said second means is a document information control system comprising:

a) means for powering said control system and said solenoid;

b) means for detecting a signal from said printer wherein said signal indicates that said document packet is to be transferred from said collating tray; and c) means for timing the transferring of said document packet from said collating tray to said post-printer receiving equipment; and d) means for actuating the transfer of said document packet from said collating tray to permit a new document packet to enter said collating tray.

8. A method for collating into a document packet the output of a printer and transferring to post-printer receiving equipment a complete designated document having one or more printed document pages, comprising the steps:

a) accepting in a collating tray from said printer each said document page, wherein said collating tray comprises a three walled printed page receptacle formed by two longitudinal side walls with proximal and distal ends and upper and lower edges, a transverse back wall having inner and outer surfaces with opposing ends and upper and lower edges connecting said proximal side wall ends, one said proximal side wall end at each said back wall opposing end, and a generally rectangular floor plate with top and bottom surfaces, two longitudinal side edges and proximal and distal end edges secured within said walls at an angle running from said back wall lower edge to said side wall distal end proximate said side wall upper edge;

b) transferring by first means said document packet from said collating tray to post-printer receiving equipment, wherein said first means for transferring said document packet from said collating tray comprises:

a solenoid mounted by a solenoid support bracket to said collating tray;

an elongated lever arm having first and second ends wherein said first lever arm end is fastened to said solenoid and pivotally secured between said lever arm ends to said solenoid support bracket; and means for ejecting said document packet from said collating tray fastened to said lever arm second end; and c) informing by second means said first means that said complete designated document is printed and said document packet is within said collating tray ready for transferring to said post-printer receiving equipment.

9. A method for collating and transferring a document packet according to claim 8, wherein said means for ejecting comprises:

a) a generally flattened base with upper and lower surfaces having proximal and distal ends fastened to said lever arm second end;

b) said back wall having a slit penetrating both said back wall surfaces and extending from said lower back wall edge into said back wall towards said upper back wall edge;

c) said floor plate having a channel penetrating both said floor plate surfaces and extending from said proximal floor plate end edge into said floor plate towards said distal floor plate end edge; and d) a finger member secured to said base proximate said base proximal end and projecting away from said base upper surface wherein said finger member slidable fits within said slit and said channel thereby entering said receptacle whereby when said solenoid is actuated said finger member moves within said slit and said channel to eject a said documents packet.

* * * * *